US007229320B2

(12) United States Patent
Saito et al.

(10) Patent No.: US 7,229,320 B2
(45) Date of Patent: Jun. 12, 2007

(54) BATTERY CONNECTION PLATE WITH VOLTAGE DETECTION ELEMENT

(75) Inventors: Kazuaki Saito, Makinohara (JP); Tomohiro Ikeda, Makinohara (JP); Kentaro Shibuya, Wako (JP); Hiroshi Kosaka, Wako (JP); Seiichi Sato, Haga-gun (JP)

(73) Assignees: Yazaki Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/353,105

(22) Filed: Feb. 14, 2006

(65) Prior Publication Data

US 2006/0183367 A1 Aug. 17, 2006

(30) Foreign Application Priority Data

Feb. 14, 2005 (JP) ..... P2005-036608

(51) Int. Cl.
*H01R 33/00* (2006.01)

(52) U.S. Cl. ..... 439/627

(58) Field of Classification Search ..... 439/801, 439/500, 627, 913, 912
See application file for complete search history.

(56) References Cited

U.S. PATENT DOCUMENTS 6,152,776 A * 11/2000 Ikeda et al. ..... 439/627
6,390,858 B2 * 5/2002 Saito et al. ..... 439/736
6,472,098 B1 * 10/2002 Sawada et al. ..... 429/163
7,077,704 B2 * 7/2006 Ikeda et al. ..... 439/627

FOREIGN PATENT DOCUMENTS

JP 2004-95380 A 3/2004

* cited by examiner

*Primary Examiner*—Neil Abrams
(74) *Attorney, Agent, or Firm*—Sughrue Mion, PLLC

(57) ABSTRACT

A voltage detection terminal mounted to a housing plate body includes a bus bar connecting portion (4*a*) which is connected to a battery electrode and a bus bar (3) by bolt-nut connection, a detector connecting portion (4*b*) connected to voltage detector, and an interconnecting portion (4*c*) interconnecting the bus bar connecting portion and the detector connecting portion. A gap (c) for absorbing a length variation of a battery cell is formed between the plate body and the bus bar connecting portion, and the interconnecting portion (4*c*) includes a slanting portion (4*c*) for preventing the interconnecting portion from interference with the bus bar is formed at part of the interconnecting portion.

3 Claims, 5 Drawing Sheets

BATTERY CONNECTION PLATE WITH VOLTAGE DETECTION ELEMENT

BACKGROUND OF THE INVENTION

1. Field of the Invention

This invention relates to a battery connection plate for connection to battery cells used, for example, in an electric car, a hybrid car or the like.

2. Related Art

In an electric car using an electric motor, a hybrid car using both of an electric car and an internal combustion engine, or the like, generally, a plurality of battery cells of a generally bar-shape, having battery electrodes each with external threads, are arranged parallel in an upstanding condition, and are collectively electrically connected together by this battery connection plate.

This conventional battery connection plate is adapted to be connected to the battery electrodes as described above, and this battery connection plate comprises bus bars having battery electrode connecting portions having through holes for respectively passing the battery electrodes, formed on and projecting respectively from distal ends of the plurality of battery cells, therethrough, and the bus bars serially connect the plurality of battery cells by inserting the battery electrodes into the respective through holes and then by bolt-fastening the battery electrodes to the respective bus bars. This battery connection plate further includes voltage detector, voltage detection terminals which are connected at their one ends to the respective voltage detector, and have at their other ends bus bar connecting portions each of which has a passage hole for the passage of the battery electrode therethrough, and connects the voltage detector to the battery electrode, and is connected to the bus bar, and a plate body.

In the conventional battery connection plate of this construction, each battery electrode is inserted into both of the through hole and the passage hole, and is passed therethrough, and a nut is fastened onto the battery electrode projecting from these holes, and as a result the battery connection plate and the battery cell are mechanically and electrically connected together. In this manner, the plurality of battery cells are serially connected, and at the same time voltage detection elements, connected to the respective voltage detection terminals, are connected to the respective battery cells.

Describing this conventional battery connection plate in further detail, the bus bar connecting portion of the voltage detection terminal is disposed in abutting relation to the plate body, and on the other hand the battery electrode connecting portion of the bus bar is bent into a generally slanting condition to be disposed above the bus bar connecting portion, and can be elastically deformed (see, for example, Japanese Patent Publication No. JP 2004-95380A, FIG. 1).

It seems that there is no problem with the battery connecting means employing the conventional battery connection plate. However, it has the following problems.

Namely, there is a slight variation in the length of the individual battery cells, and as a result there has been a fear that the plate-like bus bar connecting portion, disposed in abutting relation to the plate body, is incompletely connected to the battery electrode.

Therefore, there has been developed a structure (as shown in FIGS. 6 to 8) in which an interconnecting portion z3 is bent into a crank-shape, thereby slightly lifting a bus bar connecting portion z1 of a voltage detection terminal off a bottom surface of a recess z4 formed in a plate body z2, so that a gap z5 for absorbing a length variation of a battery cell is formed between the bottom surface of the recess z4 and the bus bar connecting portion z1. It is noted that a slot 5 is provided between the interconnecting portion Z3 and the bus bar connecting portion Z1.

On the other hand, in this kind of battery connection plate, a complicated wiring pattern is required to be formed by bus bars z6 within a limited space, and therefore even the above structure involves problems.

Namely, there are some cases where the interconnecting portion z3 of the voltage detection terminal is disposed on the direction of extending of the bus bar z6 because of layout. This will be more specifically described with reference to FIG. 6. Namely, in the case where an intermediate portion of the bus bar z6 is extended in a left direction (as indicated by dots-and-dash lines) in FIG. 6, part of the bus bar z6 interferes with the interconnecting portion z3 in pressed relation thereto, so that the interconnecting portion z3 fails to properly operate. In this condition, naturally, the length variation of the battery cell can not be absorbed.

And besides, in battery connection plates today, the layout of bus bars and voltage detection terminals has been extremely complicated, and there has been a fear that the bus bar and the voltage detection terminal interfere with each other.

SUMMARY OF THE INVENTION

It is therefore an object of this invention to provide a battery connection plate in which even in the case where a complicated wiring pattern is required to be formed by bus bars within a limited space, such wiring can be suitably achieved without interference of any bus bar with a voltage detection terminal and also without the need for extensively improving the battery connection plate, and besides the battery connection plate can be properly connected to battery cells while absorbing a length variation of the battery cells.

In order to achieve the above technical object, a battery connection plate of the present invention incorporates the following technical means.

(1) Namely, according to the invention, there is provided a battery connection plate comprising:

a plate body;

a bus bar in which a through hole is formed to which a battery electrode of a battery cell is to be inserted and fastened by bolt-nut connection;

a voltage detector capable of detecting a voltage condition of the battery cell connected with the bus bar; and a voltage detection terminal for connecting the voltage detector to the battery electrode, the voltage detection terminal including a bus bar connecting portion which is to be connected to the battery electrode and the bus bar by the bolt-nut connection, a detector connecting portion connected to the voltage detector, and an interconnecting portion interconnecting the bus bar connecting portion and the detector connecting portion; and wherein the interconnecting portion includes a slanting portion which prevents the interconnecting portion from interference with the bus bar.

(2) Further a gap for absorbing a length variation of the battery cell may be formed between the plate body and the bus bar connecting portion, and the slanting portion is provided adjacent to the bus bar connecting portion, and is slanting in a direction toward apart of the bolt-nut connection so that the slanting portion is elastically deformable to be bent.

(3) A guide wall which guides the interconnecting portion may be formed on the plate body.

In the above technical means, simultaneously when each bus bar, the corresponding voltage detection terminal and the corresponding battery electrode are mechanically and electrically connected together by the bolt-nut connection, so that the plurality of battery cells are serially connected, the voltage detector, connected to the respective voltage detection terminals, are connected to the respective battery cells.

Even in the case where the interconnecting portion of the voltage detection terminal is inevitably disposed on the direction of extending of the bus bar because of layout, the slanting portion is formed at part of the interconnecting portion, thereby preventing the interference of the interconnecting portion with the bus bar.

Furthermore, even when the interconnecting portion of the voltage detection terminal is disposed on the direction of extending of the bus bar, the bus bar and the voltage detection terminal will not interfere with each other, and can be properly connected to the battery cell, while absorbing the length variation of the battery cell.

Furthermore, the guide wall for guiding the interconnecting portion is formed on the plate body, and therefore the voltage detection terminal is prevented from being displaced out of position, and besides when fastening the battery cell to the battery connection plate by the bolt-nut connection, the bus bar connecting portion is prevented from rotating with a nut.

In the invention, the slanting portion for preventing the interconnecting portion of the voltage detection terminal from interference with the bus bar is formed at part of this interconnecting portion, and therefore even in the case where the interconnecting portion is inevitably disposed on the direction of extending of the bus bar, the battery connection plate can easily meet the complicated wiring pattern without being extensively improved.

In the invention, the battery cell, the bus bar and the voltage detection terminal can be properly electrically and mechanically connected together, while absorbing the length variation of the battery cell.

In the invention, the guide wall for guiding the interconnecting portion is formed on the plate body, and therefore the voltage detection terminal is prevented from being displaced out of position, and besides when fastening the battery cell to the battery connection plate by the bolt-nut connection, the bus bar connecting portion is prevented from rotating with the nut. Therefore, the battery connection plate can be easily assembled without damaging the bus bar connecting portion.

DETAILED DESCRIPTION OF THE PREFERRED EMBODIMENTS

Figure 1:
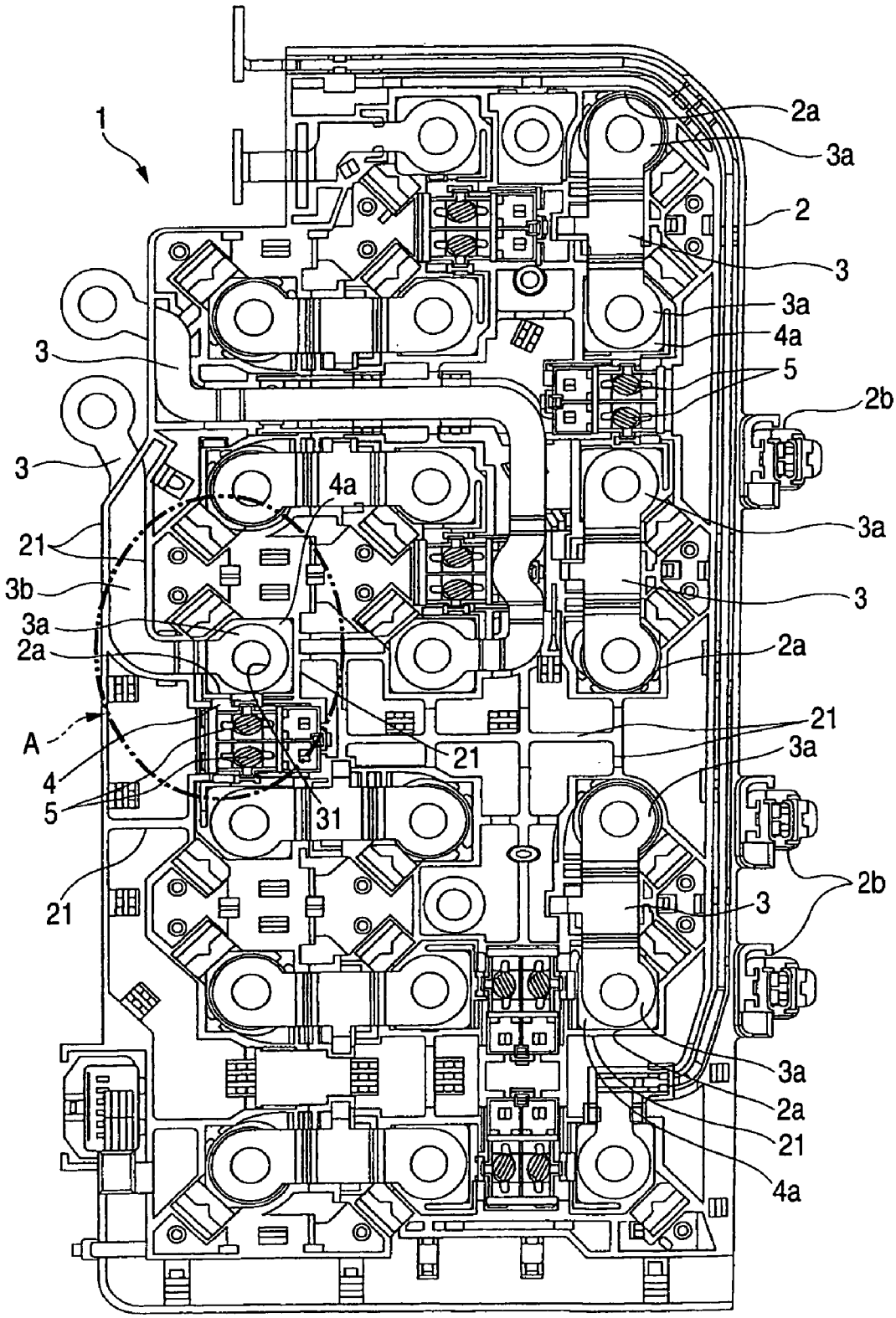
FIG. 1 is a plan view (showing a battery cell-connecting side) of a preferred embodiment of a battery connection plate of the present invention.

A preferred embodiment of a battery connection plate of the present invention will now be described. In the illustrated battery connection plate of this embodiment, a plurality of battery cells of a generally bar-shape, having battery electrodes each with external threads, are arranged parallel in an upstanding condition within a cell containing case or the like, and are collectively electrically connected together by this battery connection plate. For convenience', first, the battery connection plate will be described, and then important portions of the invention will be described.

In the drawings, reference numeral 1 denotes the battery connection plate, reference numeral 2 denotes a plate body, reference numeral 3 denote bus bars, and reference numeral 4 denotes voltage detection terminals.

The battery connection plate 1 of this embodiment comprises the plate body 2, the bus bars 3, and the voltage detection terminals 4.

As shown in FIG. 1, the plate body 2 has the appearance of a generally rectangular shape, in which a plurality of electrode contact receiving portions 2*a* are formed respectively at desired regions by rib-like projecting side walls 21 extending lengthwise and widthwise, and the bus bars and voltage detection terminals 4 (described later) are inserted in guide holes (not shown) formed in the side walls 21, and are inserted in support holes (not shown) extending through the plate body 2 between front and reverse surfaces thereof, and by doing so, the plate body 2 supports the bus bars and the voltage detection terminals so as to form a desired wiring pattern. Retaining portions 2*b* (with which a container (such as a containing case), holding the plurality of parallel-arranged battery cells B, can be detachably engaged) are formed at a right edge portion (in FIG. 1) of the plate body 2, and output terminals of the bus bars 3 (described later) are extended at the opposite edge portion thereof.

The bus bars 3 have through holes 31 each for the passage of the battery electrode b1 therethrough for electrical connection to this battery electrode. The bus bar 3 is bent in a generally slanting condition away from the plate body 2, and has a battery electrode contact portion 3*a* of a generally doughnut-shape which can be pressed against the battery electrode b1 upon resilient deformation. This battery electrode contact portion 3*a* is formed integrally with a strip-like connecting portion 3*b* which is so formed as to provide the desired wiring pattern.

The bus bars 3 serially electrically connect the plurality of battery cells B in the desired wiring pattern so as to output a voltage. The shape of other portion of the battery electrode contact portion 3*a*, that is, the wiring shape of the strip-like connecting portion 3*b*, is so formed as to provide the desired wiring pattern. The bus bars 3, thus formed, are supported on the plate body 2, with the connecting portions 3*b* laid on the front/reverse surface of the plate body 2, and the battery electrode contact portions 3*a* are elastically-deformably received in the respective electrode contact receiving portions 2*a*.

The voltage detection terminal 4 includes a bus bar connecting portion 4*a* of a generally rectangular shape which has an passage hole 41 for the passage of the battery electrode b1 (passing through the through hole 31) therethrough, and is electrically connected to the battery electrode b1 and the bus bar 3 by bolt-nut connection, and a detector connecting portion 4*b* which is connected to voltage detector 5 comprising a voltage detection element for enabling the checking of a voltage condition of the corresponding battery cell B, and an interconnecting portion 4*c* interconnecting the bus bar connecting portion 4*a* and the detector connecting portion 4*b*. A gap for absorbing a length variation of each battery cell B is formed between the plate body 2 and the bus bar connecting portion 4*a*.

As described above, the voltage detection terminal 4 is connected at its one end to the voltage detection element 5 for enabling the checking of the voltage condition of the battery cell B, and like the bus bar 3, the wiring shape of the interconnecting portion 4*c* is so formed as to provide the desired wiring pattern. The voltage detection terminal 4, thus formed, is supported on the plate body 2, with the interconnecting portion 4*c* laid on the front/reverse surface of the plate body 2, and the bus bar connecting portion 4*a* is disposed between the battery electrode contact portion 3*a* and a bottom surface of the electrode contact receiving portion 2*a*.

Next, the important portions of the invention will be described.

In the plate body 2, the plurality of electrode contact receiving portions 2*a* are formed respectively at the desired regions by the side walls 21 in such a manner that the side walls 21 have openings through which the respective bus bars 3 and voltage detection terminals extend. This arrangement is classified into a type in which the direction of extending of the connecting portion 3*b* from the battery electrode contact portion 3*a* is different from the direction of extending of the interconnecting portion 4*c* from the voltage detection terminal 4 and a type in which the two direction generally coincide with each other.

In the case (that is, in the former type) where the direction of extending of the connecting portion 3*b* from the battery electrode contact portion 3*a* is different from the direction of extending of the interconnecting portion 4*c* from the voltage detection terminal 4, the connecting portion 3*b* and the battery electrode contact portion 3*a* (formed by bending) of the bus bar 3 will not physically interfere with the interconnecting portion 4*c* (formed by bending).

However, in the case (that is, in the latter type) where the direction of extending of the connecting portion 3*b* from the battery electrode contact portion 3*a* coincides with the direction of extending of the interconnecting portion 4*c* from the voltage detection terminal 4, the connecting portion 3*b* and the battery electrode contact portion 3*a* (formed by bending) of the bus bar 3 will physically interfere with the interconnecting portion 4*c* (formed by bending) unless some measure is taken. Such a portion, corresponding to this case, is a portion A in FIG. 1, and this portion A will be described below in detail.

Figure 2:
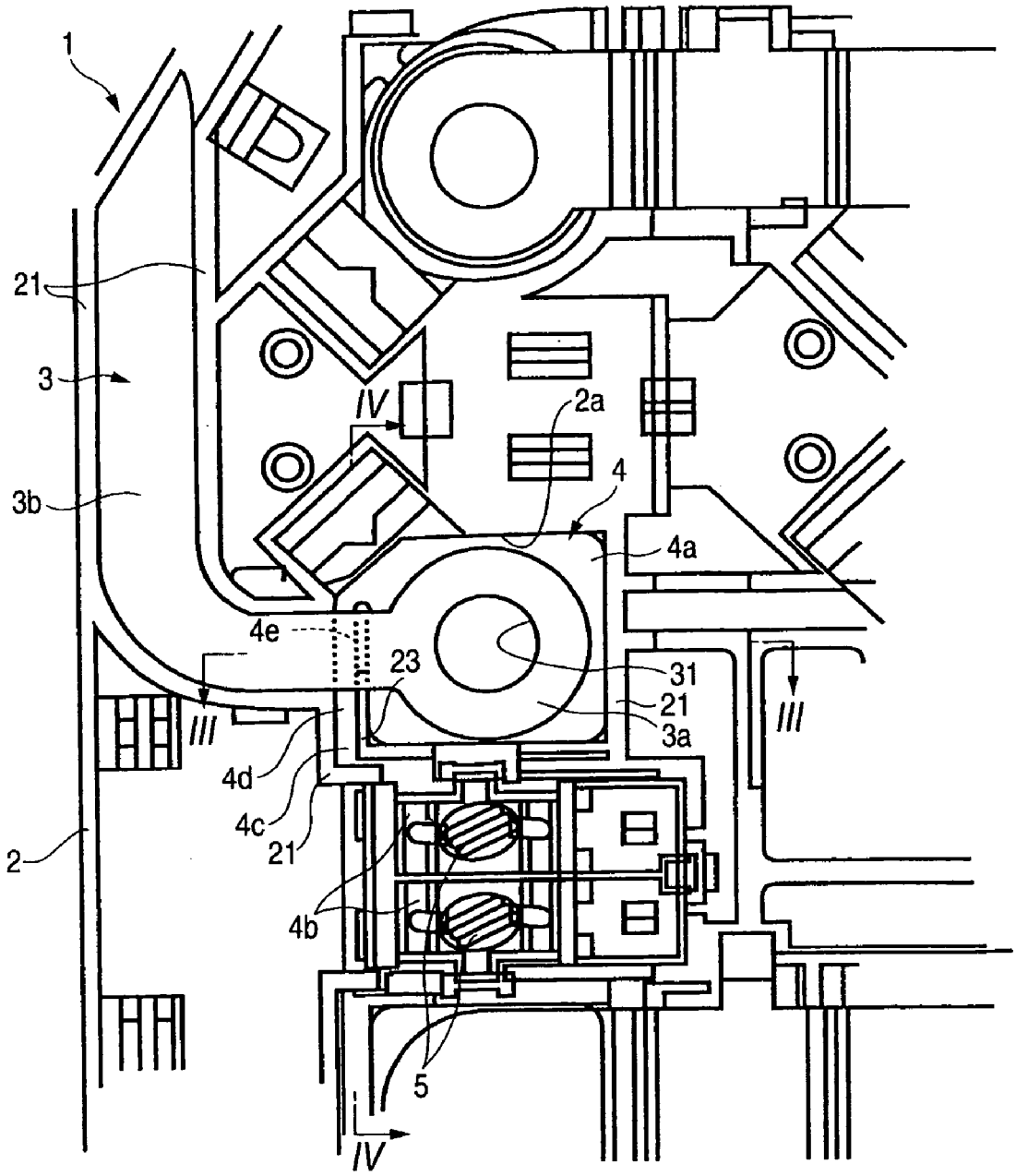
FIG. 2 is an enlarged view of a portion A of FIG. 1.
Figure 4:
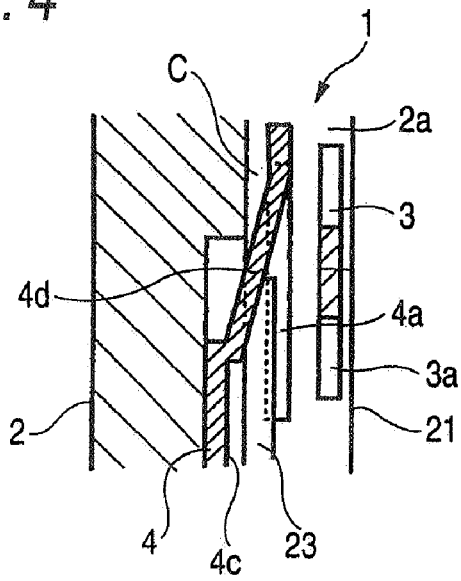
FIG. 4 is a cross-sectional view taken along the line IV—IV of FIG. 2.
Figure 5:
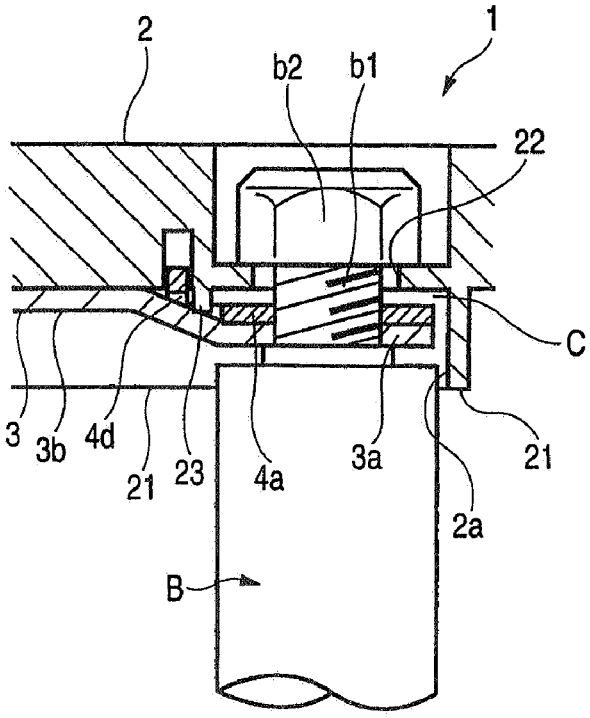
FIG. 5 is a cross-sectional view taken along the line III—III of FIG. 2, showing a condition in which a battery cell is connected.
Figure 6:
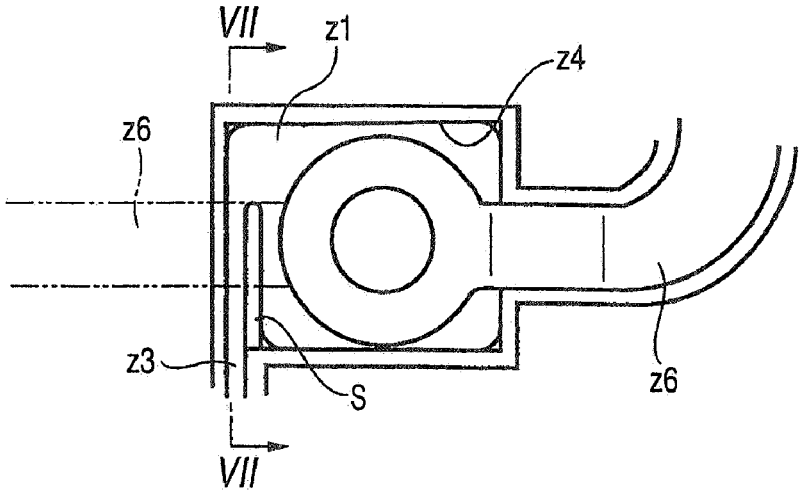
FIG. 6 PRIOR ART
FIG. 6 is an enlarged plan view (showing a battery cell-connecting side) of a conventional electrode contact receiving portion.
Figure 7:
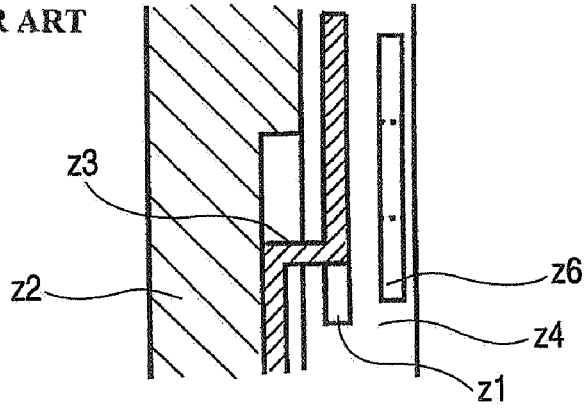
FIG. 7 PRIOR ART
FIG. 7 is a cross-sectional view taken along the line VII—VII of FIG. 6.
Figure 8:
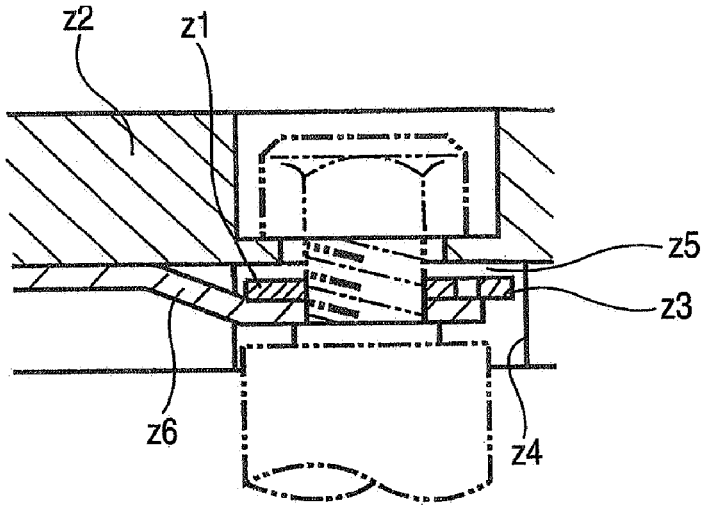
FIG. 8 PRIOR ART
FIG. 8 is an enlarged vertical cross-sectional view of the conventional electrode contact receiving portion, showing a condition in which a battery cell is connected.

As shown in FIG. 2 (which is an enlarged view of the portion A of FIG. 1), the electrode contact receiving portion 2*a* (which is formed by the upstanding side walls 21 jointly assuming a generally rectangular shape) is formed at the plate body 2 in a recessed manner, and a communication hole 22 of a necessary diameter for passing the battery electrode therethrough is formed in a generally central portion of this electrode contact receiving portion 2*a*. Further, the voltage detector 5 is located at a region below (in FIG. 2) this electrode contact receiving portion 2*a*, and is disposed in a position deeper than the bottom surface of the electrode contact receiving portion 2*a*. As shown in FIG. 4, the plate body 2 has a step formed between the bottom surface of the electrode contact receiving portion 2*a* and a bottom surface on which the voltage detector 5 is mounted.

As shown in FIG. 4, with respect to the voltage detection terminal 4, the detector connecting portion 4*b* and part of the interconnecting portion 4*c* (continuous with this detector connecting portion 4*b*) extend in abutting relation to the plate body 2, and then the interconnecting portion 4*c* extends upwardly at an intermediate portion thereof, and further part of the interconnecting portion 4*c* is slanting in a direction toward the bolt-nut connecting portion to form a slanting portion 4*d*, and is continuous with an upper left corner portion of the bus bar connecting portion 4*a*.

This slanting portion 4*d* has such a required angle that the gap C for absorbing the length variation of the battery cell B is formed between the bus bar connecting portion 4*a* and the bottom surface of the electrode contact receiving portion 2*a*. The bus bar connecting portion 4*a*, thus horizontally lifted off the bottom surface of the electrode contact receiving portion 2*a*, can be bent in the upward-downward direction by an amount corresponding to the gap C.

Further, guide walls for guiding the interconnecting portion 4*c* (which includes the slanting portion 4*d*, and extends to the bus bar connecting portion 4*a*) are provided on the plate body 2. As shown in FIG. 2, these guide walls are formed by part of the side wall 21, disposed adjacent to the interconnecting portion 4*c*, and a partition wall 23 of a generally L-shape fitted in a slit 4*e* formed between the interconnecting portion 4*c* and the bus bar connecting portion 4*a*. An upper surface of the partition wall 23 does not project beyond the interconnecting portion 4*c*.

Figure 3:
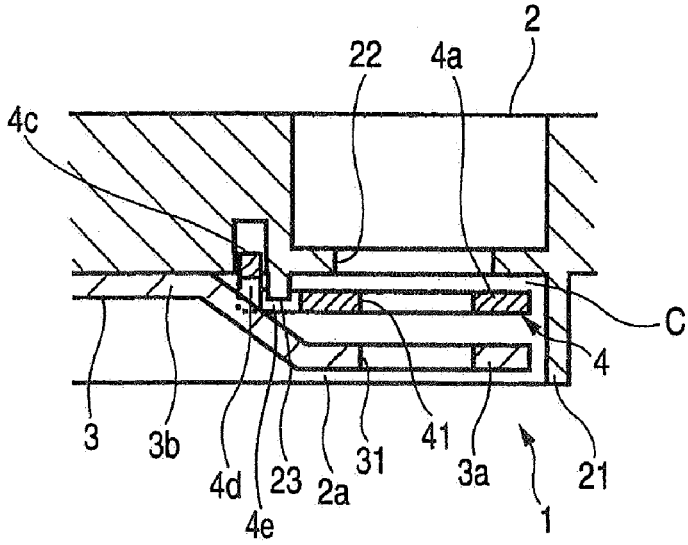
FIG. 3 is a cross-sectional view taken along the line III—III of FIG. 2.

On the other hand, the connecting portion 3*b* of the bus bar 3, installed over the plate body 2, is bent into a generally slanting condition just before the slanting portion 4*d*, and does not interfere with the slanting portion 4*d* as shown in FIG. 3, so that the battery electrode contact portion 3*a* is horizontally lifted above the bus bar connecting portion 4*a*.

In the battery connection plate 1 of the above construction, each battery electrode b1 is inserted into both of the through hole 31 and the passage hole 41, and is passed therethrough, and a nut b2 is fastened onto the bolt-like battery electrode b1 (by bolt-nut connection) projecting from the communication hole 22 formed through the generally-central portion of the electrode contact receiving portion 2*a*, and as a result the battery connection plate 1 and the battery cell B are mechanically and electrically connected together. In this manner, the plurality of battery cells B are connected together in the desired wiring pattern, and at the same time the voltage detector 5, connected to the respective detection terminals 4, are connected to the respective battery cells B.

At this time, even in the case where the direction of extending of the connecting portion 3*b* from the battery electrode contact portion 3*a* coincides with the direction of extending of the interconnecting portion 4*c* from the voltage detection terminal 4, the connecting portion 3*b* of the bus bar 3 does not interfere with the slanting portion 4*d*, and the battery electrode contact portion 3*a* is horizontally lifted above the bus bar connecting portion 4*a*, and the gap C for absorbing the length variation of the battery cell B is secured.

When fastening the nut b2 onto the battery electrode b1, the electrode contact receiving portion 2*a* and the partition wall 23 jointly prevent the bus bar connecting portion 4*a* from rotation with the nut b2, and therefore the connection of the battery cell B can be easily effected without damaging the bus bar connecting portion 4*a*.

In the battery connection plate of this embodiment, the slanting portion 4*d* for preventing the interconnecting portion 4*c* of the voltage detection terminal 4 from interference with the bus bar 3 is formed at part of this interconnecting portion 4*c*, and therefore even in the case where the interconnecting portion 4*c* is inevitably disposed on the direction of extending of the bus bar 3, this battery connection plate can easily meet the complicated wiring pattern without being extensively improved, while securing the gap C for absorbing the length variation of the battery cell C.

Although the battery connection plate of this embodiment has been described above, the above embodiment is merely one example of preferred embodiments of the invention, and the invention is not limited to the above embodiment, and various modifications can be made without departing from the subject matter of the invention.

For example, although the slanting portion 4*d* is provided adjacent to the bus bar connecting portion 4*a*, the slanting portion 4*d* can be provided at an arbitrary portion of the interconnecting portion 4*c* so as to prevent the interconnecting portion 4*c* from interference with the bus bar 3.

What is claimed is:

1. A battery connection plate comprising:

a plate body;

a bus bar mounted on the plate body and in which a through hole is formed to which a battery electrode of a battery cell is to be inserted and fastened by bolt-nut connection;

a voltage detector capable of detecting a voltage condition of the battery cell connected with the bus bar; and a voltage detection terminal for connecting the voltage detector to the battery electrode, the voltage detection terminal including a bus bar connecting portion which is to be connected to the battery electrode and the bus bar by the bolt-nut connection, a detector connecting portion connected to the voltage detector, and an interconnecting portion interconnecting the bus bar connecting portion and the detector connecting portion and extending transversely across the bus bar; and wherein the interconnecting portion includes a slanting portion which prevents the interconnecting portion from interfering with the bus bar.

2. A battery connection plate according to claim 1, wherein a gap for absorbing a length variation of the battery cell is formed between the plate body and the bus bar connecting portion, and the slanting portion is provided adjacent to the bus bar connecting portion, and is slanting in a direction toward a part of the bolt-nut connection so that the slanting portion is elastically deformable to be bent.

3. A battery connection plate according to claim 1, wherein a guide wall which guides the interconnecting portion is formed on the plate body.

* * * * *